US007360647B2

(12) United States Patent
Ogg

(10) Patent No.: US 7,360,647 B2
(45) Date of Patent: Apr. 22, 2008

(54) PACKAGING SYSTEM AND METHOD

(75) Inventor: Richard Ogg, Littlestown, PA (US)

(73) Assignee: Ogg Design, Inc., Littlestown, PA (US)

( * ) Notice: Subject to any disclaimer, the term of this patent is extended or adjusted under 35 U.S.C. 154(b) by 572 days.

(21) Appl. No.: 11/019,235

(22) Filed: Dec. 23, 2004

(65) Prior Publication Data

US 2005/0150783 A1 Jul. 14, 2005

Related U.S. Application Data

(60) Provisional application No. 60/534,704, filed on Jan. 8, 2004.

(51) Int. Cl.
*B65D 75/00* (2006.01)

(52) U.S. Cl. ..... 206/139; 206/193; 206/427; 53/48.1; 53/398

(58) Field of Classification Search ..... 206/432, 206/427, 497, 429, 153, 196, 193, 139; 53/48.1, 53/48.2, 398
See application file for complete search history.

(56) References Cited

U.S. PATENT DOCUMENTS 2,415,218 A * 2/1947 Rhodes et al. ..... 294/87.26
2,685,401 A * 8/1954 Guyer ..... 206/162
3,532,214 A * 10/1970 Helms ..... 206/193
3,687,282 A * 8/1972 Owen ..... 206/162
3,884,354 A 5/1975 Guenther et al.
3,923,155 A 12/1975 Tanzer
3,951,259 A * 4/1976 Oglesbee ..... 206/164
3,991,880 A * 11/1976 Austrins et al. ..... 206/431
4,300,681 A * 11/1981 Klygis et al. ..... 206/428
4,324,328 A 4/1982 Champlin
4,328,891 A * 5/1982 Elward ..... 206/158
4,332,325 A 6/1982 Manizza
4,471,870 A 9/1984 Uhlig
4,560,064 A 12/1985 Peterson et al.
4,609,101 A * 9/1986 Ullman ..... 206/432
4,789,063 A 12/1988 Hammett
4,911,300 A 3/1990 Colonna
4,932,528 A * 6/1990 Benno ..... 206/432
5,351,814 A 10/1994 Apps
5,474,172 A 12/1995 Zavatone et al.
5,487,463 A 1/1996 Harris
5,624,032 A 4/1997 Yucknut et al.
5,675,960 A * 10/1997 Weaver ..... 53/397

(Continued)

FOREIGN PATENT DOCUMENTS

DE 3616032 A1 * 11/1986

*Primary Examiner*—David T. Fidei
(74) *Attorney, Agent, or Firm*—William C. Schrot; Berenato, White & Stavish, LLC

(57) ABSTRACT

The present invention is directed to a system for packaging bottles having a neck portion. The system includes a tray unit and a bridge. The tray unit has a planar base, first and second opposite sidewalls, and first and second opposite end walls. The sidewalls and end walls extend outwardly from a periphery of the base and connect thereto to define a rectangular structure for holding a plurality of bottles arranged in a series of rows. The bridge has a central planar portion and a plurality of arcuate recesses extending into a periphery of the central planar portion. Each recess is sized to receive a neck portion of one of the bottles. A method of packaging bottles having neck portions is also disclosed.

34 Claims, 9 Drawing Sheets

U.S. PATENT DOCUMENTS 5,706,936 A 1/1998 Bernstein
5,718,330 A 2/1998 Auffret et al.
5,775,486 A 7/1998 Edqvist
5,816,391 A 10/1998 Harris
5,878,876 A 3/1999 Galbierz et al.
5,913,444 A * 6/1999 Steiner ..... 220/512
6,394,272 B1 5/2002 Domansky
2001/0025824 A1 * 10/2001 Olivero ..... 211/74

* cited by examiner

Fig 15
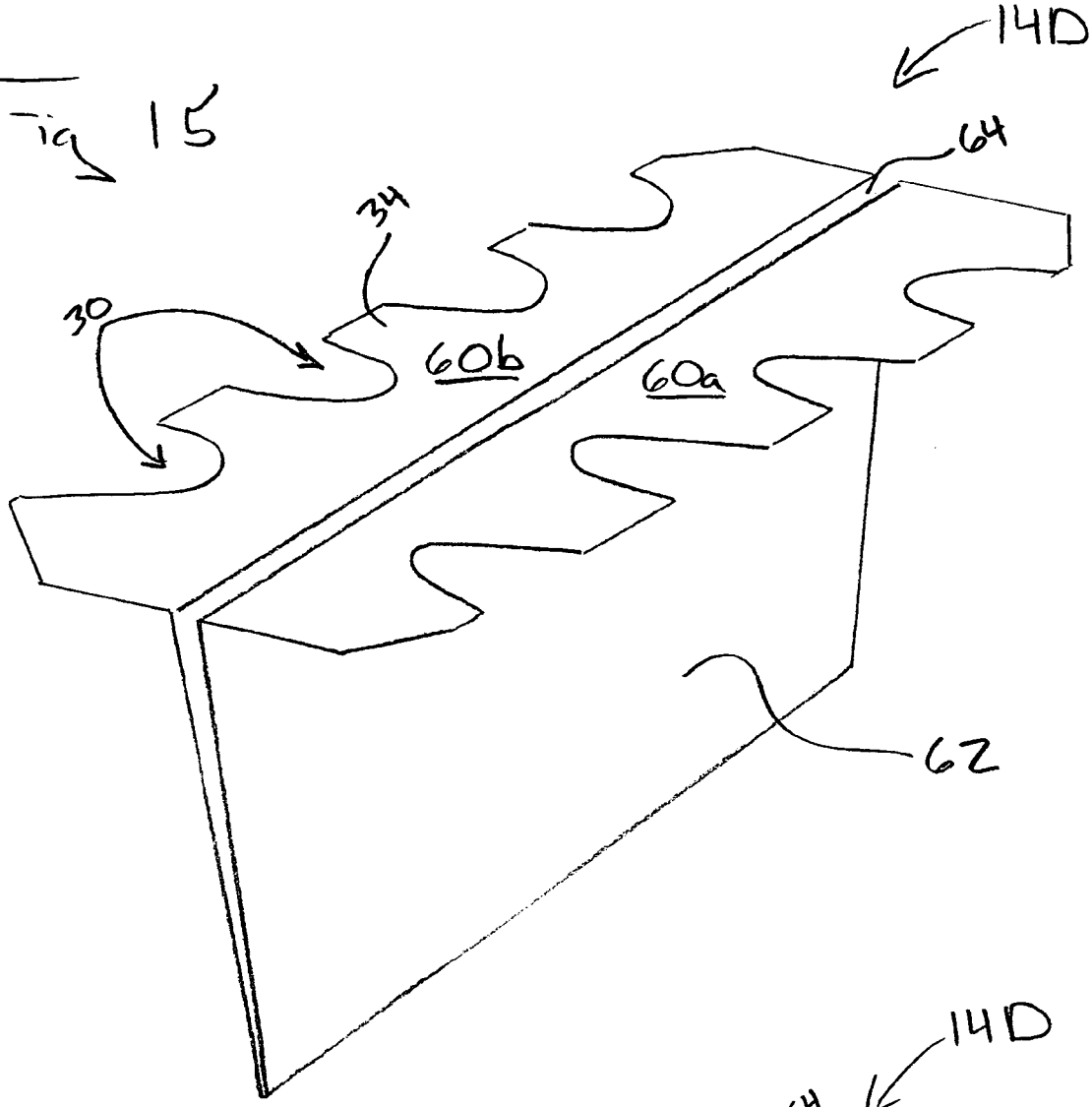
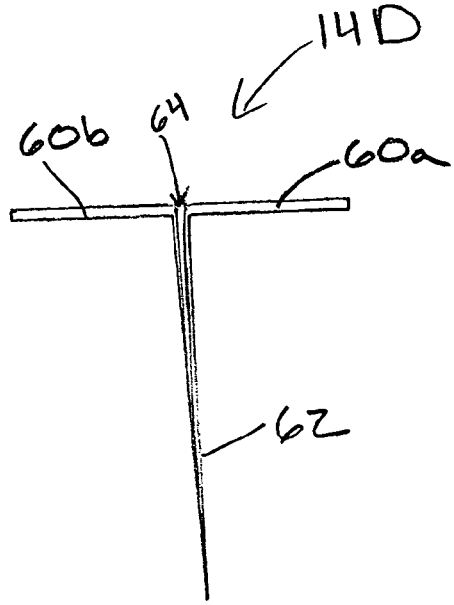
Fig 16

PACKAGING SYSTEM AND METHOD

CROSS-REFERENCE TO RELATED APPLICATION AND CLAIM TO PRIORITY

The present application is based on provisional application Ser. No. 60/534,704, filed Jan. 8, 2004, the disclosure of which is included herein by reference to which priority is claimed.

FIELD OF THE INVENTION

The present invention relates to a bulk packaging system and method. The system includes a tray unit and locator bridge. The system controls alignment and positioning of a plurality of containers during shrink-wrapping, transport and/or storage of the containers.

BACKGROUND OF THE INVENTION

Various systems for packaging containers, such as PET (Polyethylene Terephthalate) bottles, have been developed. PET bottles are widely used for products such as mineral water, juice, soda, edible oil, pharmaceuticals, cosmetics, etc. When shrink-wrapping and/or storing packaged containers, it is often important that the containers do not shift or tilt out of position. Containers are typically designed to withstand a predetermined top load. Top load represents the downward forces acting against the top of a bottle or package, such as from stacking on store shelves, in warehouses, or in trucks. The top load capability of a bottle or package is the amount of such forces it is able to withstand without deforming. Typically, containers are designed to withstand the maximum amount of top load when downward forces are perpendicular to the top and bottom of the container. Finite element analysis (FEA) is sometimes used to determine top load in CAD. Thus, tilting or shifting of containers, sometimes caused during shrink-wrapping operations or general handling and stacking of bulk containers in ware-house situations, decreases the top load capabilities. As a result, the packaged containers may be deformed or destroyed.

In order to provide adequate top load support, some conventional packaging systems include a cardboard or plastic crate that completely encases the containers being packaged. The crate may include dividers or spacers for aligning the bottles therein. Although sufficient top load capabilities may be provided, such packaging systems are relatively expensive due to material costs of the packaging.

Other packaging systems include a tray having sidewalls. Containers are placed in the tray. In order to maintain control of the containers therein, the sidewalls typically extend upwardly to a height of at least 30%, more typically 40% or more, of the total height of the containers. In general, the greater the height of the sidewall relative to the total height of the container, the greater the amount of control and stability of the containers being bulk-packaged. However, material costs are also increased. In addition, such conventional packaging trays often fail to control shifting or tilting of the containers within the tray for bulk packaging applications requiring relatively high top load capability.

Basket carriers are also known in the art, and include a base with sides extending upwardly over a majority of the bottle, but leaving the bottlenecks exposed. Basket carriers typically include spacers to align the bottles, as well as a handle. Such carriers are acceptable for marketing several containers, such as a six-pack of bottles. However, top load capability is often poor. In addition, material costs are relatively high. As such, they are unacceptable for many bulk-packaging applications.

Other systems include a plastic or cardboard panel having a plurality of openings that snap over and around the necks of the bottles. The bottles are pushed through the openings, which completely encircle the bottlenecks. Such panels are sometimes used in conjunction with a strap that encircles the bottles being packaged. Such packaging systems are typically formed from plastic, and are relatively expensive to manufacture and install on the containers. Such systems are typically utilized for marketing, as an alternative to basket carriers. They are typically unacceptable for many bulk-packaging applications, and must be crated during storage and/or transport.

There is a need for a packaging system that is inexpensive, having relatively low material costs. The packaging system should also provide optimal top load capabilities for each individual container, adding both dimensional and directional control to the plurality of containers being bulk-packaged, without increasing cost.

SUMMARY OF THE INVENTION

The present invention is directed to a system for packaging bottles having a neck portion. The system includes a tray unit and a bridge. The tray unit has a planar base, first and second opposite sidewalls, and first and second opposite end walls. The sidewalls and end walls extend outwardly from a periphery of the base and connect thereto to define a rectangular structure for holding a plurality of bottles arranged in a series of rows. The bridge has a central planar portion and a plurality of arcuate recesses extending into a periphery of the central planar portion. Each recess is sized to receive a neck portion of one of the bottles. The recesses engage the necks of containers being packaged just below their corresponding support flanges or closure caps. The bridge controls and maintains the alignment of the containers in the tray unit, minimizing any shifting or tilting of the containers during shrink-wrapping operations, transport and/or storage.

Another disclosed system for packaging bottles having a neck portion is disclosed. The system includes a rectangular plate having a base on which a plurality of bottles stand in a present series of rows. The system also includes a bridge having a central planar portion with at least one aperture extending through the central planar portion. A plurality of arcuate recesses extend into a periphery of the central planar portion. Each recess and each aperture are sized to receive a neck portion of one of the bottles.

The present invention also relates to a method of packaging a plurality of bottles. A rectangular plate having a substantially planar base is provided. A plurality of bottles are arranged on the plate in a series of rows. Each of the bottles has a neck portion and a top. The tops of the bottles lie on a first plane. A bridge is provided. The bridge has a central planar portion with first and second opposite sides and first and second opposite ends. The central planar portion includes a plurality of arcuate recesses extending into a periphery of the first and second sides. Each recess is sized to receive a neck portion of one of the bottles. The bridge is aligned with the bottles so that the central planar portion is above the tops and angled relative to the first plane. The first side is positioned against a first outer row of the bottles so that the recesses along the first side engage the necks of the bottles of the first outer row. The second side is positioned against a second outer row opposite the first outer row so that the recesses along the second side engage the necks of the bottles of the second outer row.

BRIEF DESCRIPTION OF THE FIGURES

FIG. 15 is a perspective view of a bridge according to a fifth embodiment;

FIG. 16 is an elevational view of the bridge shown in FIG. 15; and

DETAILED DESCRIPTION OF THE INVENTION

Figure 1:
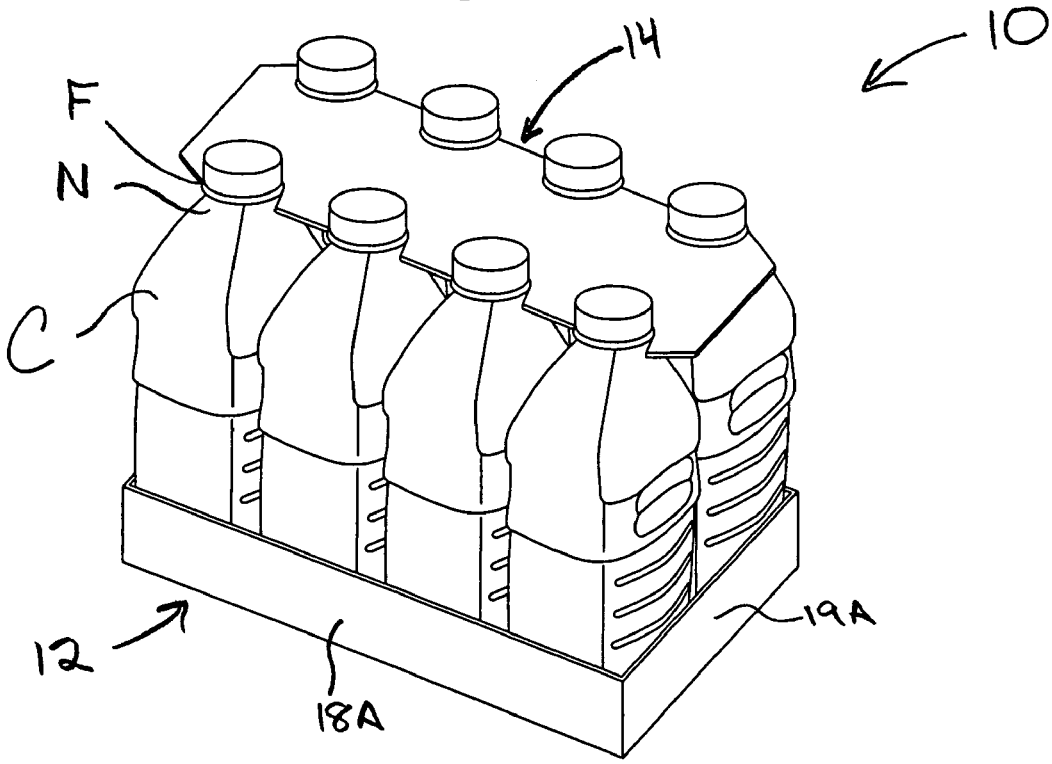
FIG. 1 is a perspective view of a packaging system according to a first embodiment showing a tray unit and bridge holding two rows of containers.
Figure 2:
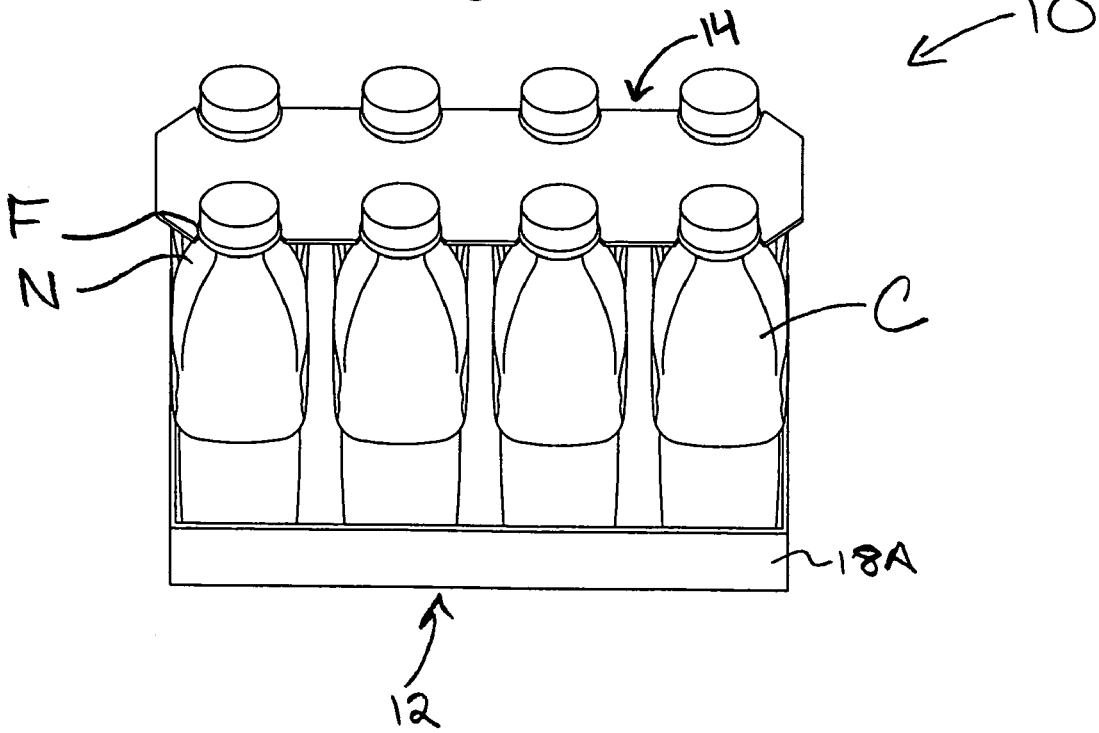
FIG. 2 is another perspective view of the system shown in FIG. 1.

A packaging system 10 according to a first embodiment of the present invention is best shown in FIGS. 1 and 2. Packaging system 10 comprises a tray unit 12 and a bridge 14. Tray unit 12 and bridge 14 maintain a plurality of containers C, such as PET bottles, in a desired position so that shifting of the containers C is minimized while the containers are being shrink-wrapped, transported and/or stored. Packaging system 10 is depicted in FIGS. 1 and 2 as holding eight containers C for purposes of explanation only. However, packaging system 10 may be configured to hold any number of containers C. For example, packaging system 10 may be used to control the positioning of two adjacent containers C, but may also be used to control two parallel rows of containers C, wherein each row includes two or more containers C.

Figure 3:
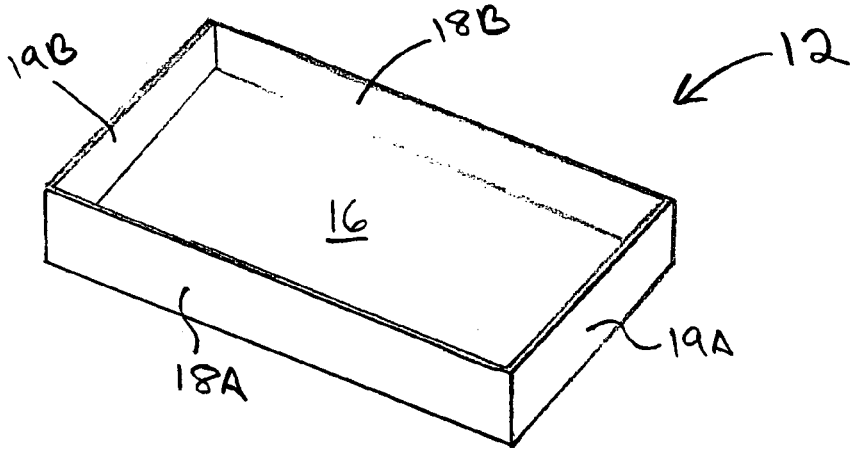
FIG. 3 is a perspective view of the tray unit according to the first embodiment.
Figure 4:
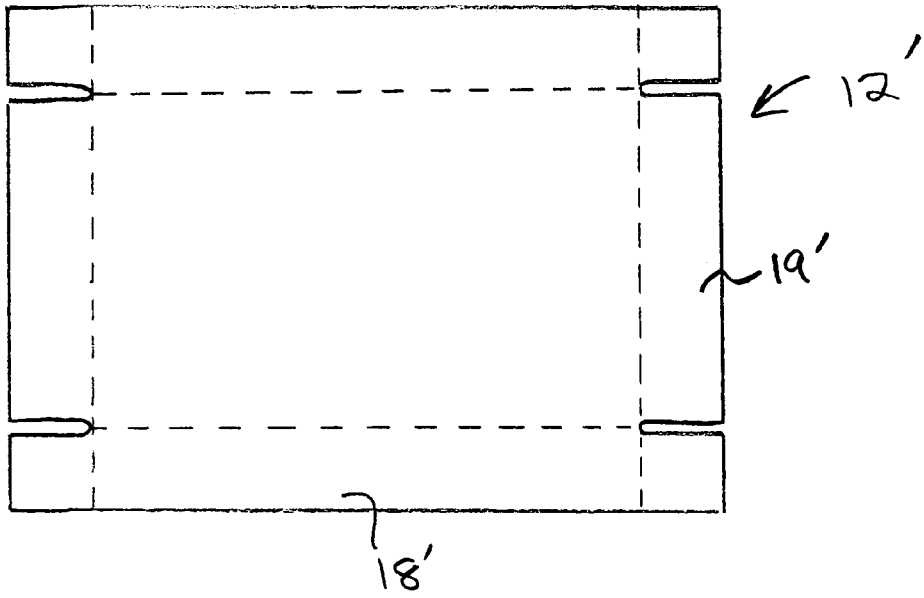
FIG. 4 is a plan view of a cardboard piece for forming the tray unit shown in FIG. 3, with fold lines shown as dashed lines.

As best shown in FIG. 3, tray unit 12 includes a base 16, first and second opposite sidewalls 18A, 18B, and first and second opposite end walls 19A, 19B. Tray unit 12 may be formed from a foldable substrate, such as single layer cardboard, corrugated cardboard, or plastic sheet material. Alternatively, tray unit 12 may be formed from wood or wood composite, such as chipboard, or a molded or extruded plastic. Tray unit 12 is preferably formed from one piece of corrugated cardboard 12', as best shown in FIG. 4. Outer portions 18' and 19' may be folded to form sidewalls 18A, 18B and end walls 19A, 19B surrounding base 16. Fold lines are shown as dashed lines. Portions 18', 19' may be folded, and either glued or stapled to form sidewalls 18A, 18B and end walls 19A, 19B.

Sidewalls 18A, 18B and end walls 19A, 19B are relatively low, extending upwardly from base 16 to a height that is about 15% to about 20% of the total height of the containers C, as best shown in FIGS. 1 and 2. By contrast, conventional packaging trays typically include sidewalls that extend upwardly to a height that is at least 30% of the total height of the containers, more typically 40% or more of the total container height. Alternatively, conventional packaging systems completely encase the containers.

Compared to conventional packaging trays, the height of sidewalls 18A, 18B and end walls 19A, 19B in the present invention may be minimized due to the additional support provided by bridge 14. It should be understood, however, that the dimensions of tray unit 12, and material used to form tray unit 12, are based on the dimensions of the particular containers being packaged, as well as the required tolerances necessary for retaining containers C in tray unit 12. It should be understood that the precise dimensions of tray unit 12 will vary depending on the size of containers C being received therein.

Figure 5:
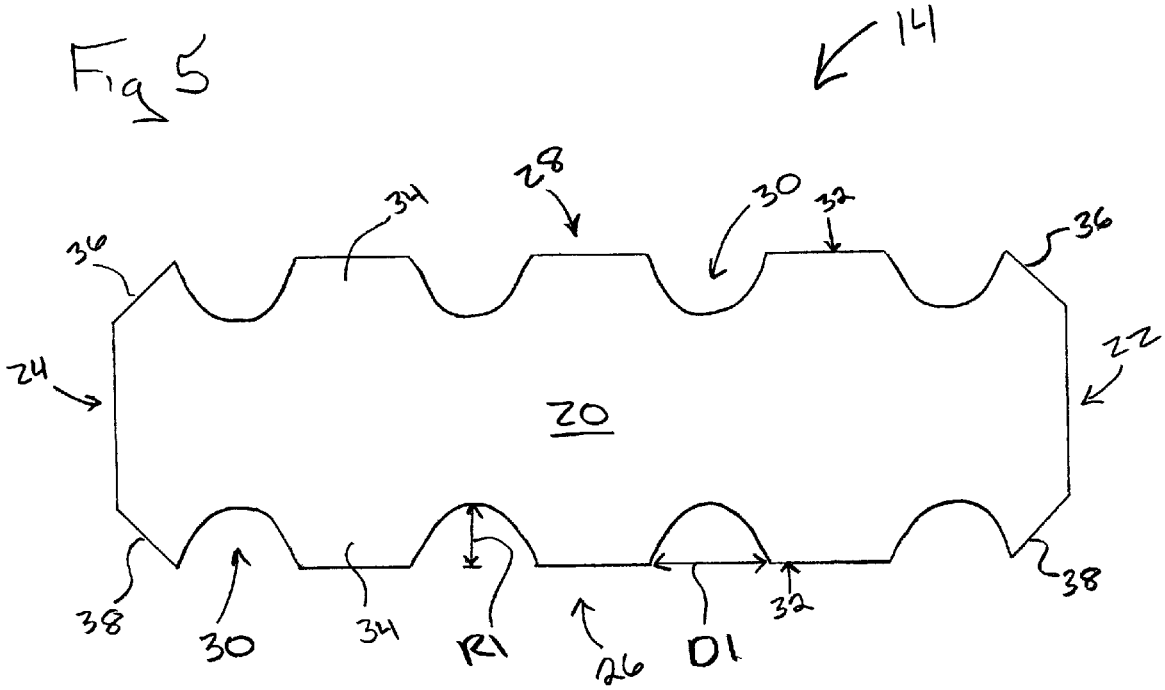
FIG. 5 is a plan view of the bridge according to the first embodiment.

As best shown in FIG. 5, bridge 14 includes a central planar portion 20 having first and second opposite ends 22, 24 and first and second opposite sides 26, 28. Each side includes one or more arcuate recesses 30 extending into central planar portion 20 from a periphery 32 of bridge 14. Preferably, each recess has an arc of about 180° or less. Adjacent recesses 30 define projections 34. Preferably, bridge 14 is formed from a single sheet of single-layer or corrugated cardboard. However, bridge 14 may also be formed from more rigid materials, such as chipboard or plastic, if additional support is required. The material thickness and configuration used to form bridge 14, as well as tray unit 12, may be determined by the number and weight of containers C being packaged.

Containers C are positioned in tray unit 12, with the bottoms of containers C resting on base 16, as best shown in FIGS. 1 and 2. Bridge 14 is then slipped into place so that each recess 30 fits against a neck N of each container C just below a support flange F. Many standard containers, such as PET bottles, include a flange extending outwardly from the bottleneck, just below a threaded portion of the bottle that receives the closure cap. Bridge 14 is fitted onto containers C so that recesses 30 engage necks N just below flanges F. Bridge is thereby held in place by flanges F, and shifting and/or inward tilting of containers C is controlled. If the containers being packaged do not include a flange, bridge 14 may be fitted just below the closure caps on the containers, which typically have an axial diameter greater than the diameter of the corresponding bottleneck.

As best shown in FIG. 5, each recess 30 may have a partial elliptical configuration, wherein a lateral radius, shown by arrow R1, is about the same as the radius of neck N of container C measured just below flange F. Thus, bridge 14 does not surround the entire neck N. In this way, bridge 14 may be easily slipped into place. A longitudinal diameter of each recess 30, shown by arrow D1, is preferably slightly greater than the diameter of neck N of container C measured just below flange F. This configuration allows bridge 14 to be easily slipped into place just below flanges F. It should be understood that the specific dimensions of arcuate recesses 30 will vary depending on the specific dimensions of containers C being packaged. For example, many conventional PET bottles have a bottleneck diameter of between about 28 millimeters (mm) to about 53 mm. Thus, the dimensions of recesses 30 will vary depending on the particular packaging application. Further, the precise dimensions of bridge 14 will vary depending on the size and number of containers being packaged.

Preferably, the overall dimensions of bridge 14 do not exceed the downward footprint of base 16 of tray unit 12. For example, ends 22, 24 of bridge 14 may extend past the last containers C of the rows about 0.125 inches to about 0.250 inches, but preferably do not extend past the plane of end walls 19A, 19B, respectively. Each of ends 22, 24 may include first and second angled corners 36, 38, which angle inwardly toward a corresponding recess 30. Preferably, angled corners 36, 38 extend at an angle of about 45° relative to the corresponding side 26 or 28.

As best shown in FIGS. 1 and 2, the number of recesses 30 corresponds to the number of containers C being packaging on tray unit 12. Tray unit 12 and bridge 14 may be configured to hold two or more containers C. Tray unit 12 may be configured so that containers C are positioned on base 16 in two parallel rows, each row having 1 or more containers C. Thus, packaging system 10 may hold two, four, six, eight, ten, twelve, or more containers in two rows. It should be understood that any number of containers C may be packaged using packaging system 10. However, the number of containers C packaged in tray unit 12 may depend on the size and weight of each container C, as well as storage and handling considerations.

The present invention may be used with various types of containers, so long as bridge 14 may be fitted below either flange F, a closure cap, or some other outwardly protruding portion on neck N. Packaging system 10 is particularly well suited for bulk packaging containers such as PET soda bottles, juice bottles, and the like. Support flanges F are standard on most PET bottles or other containers having a closure cap. Other container configurations having a portion equivalent to a standard support flange F may also be packaged using the disclosed invention, such as bottles having a diameter differential between their caps and necks.

Figure 6:
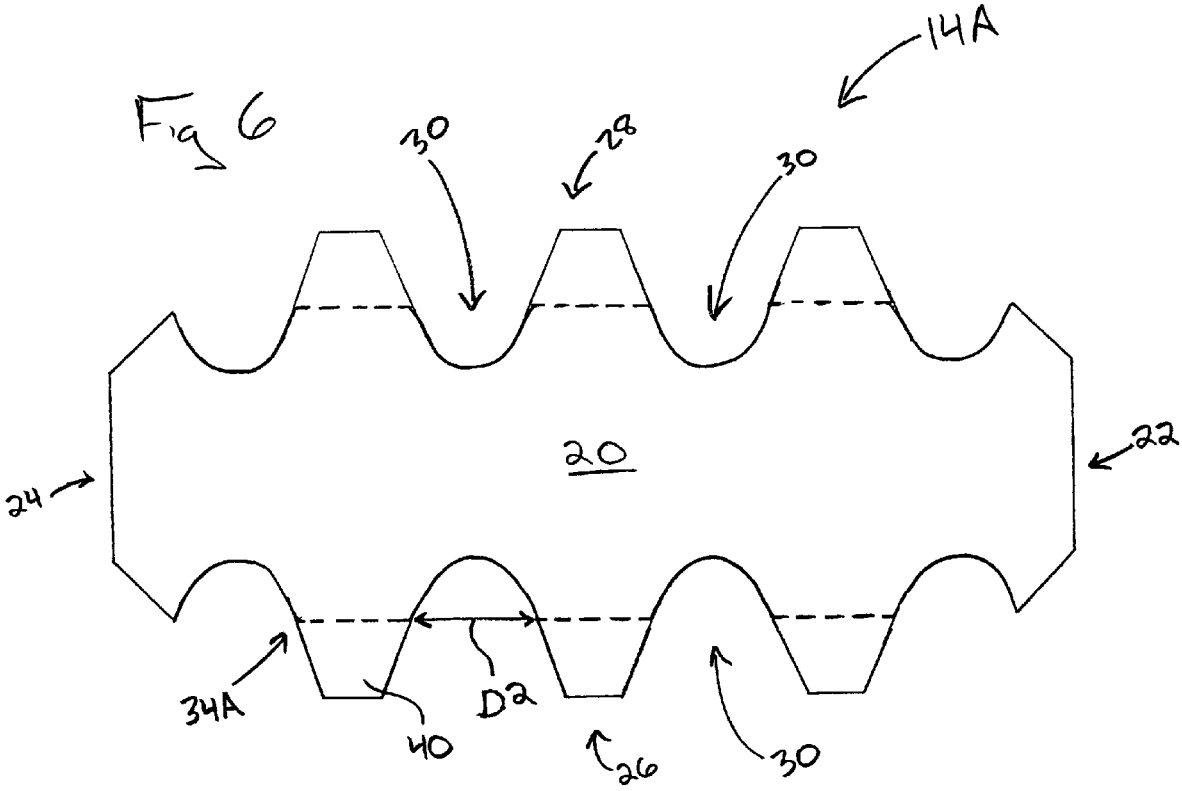
FIG. 6 is a plan view of a bridge according to a second embodiment.
Figure 7:
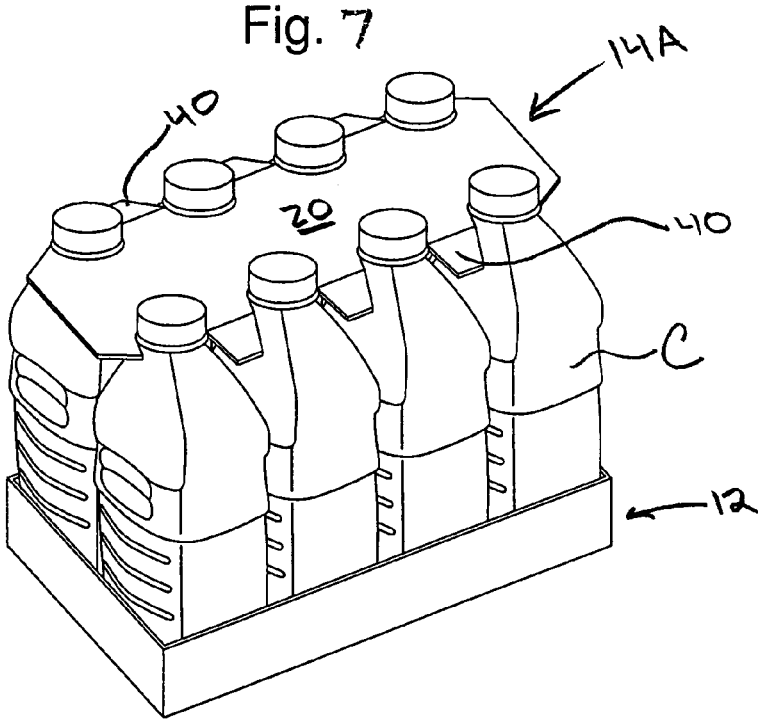
FIG. 7 is a perspective view of the tray unit and bridge according to the second embodiment holding two rows of containers.
Figure 8:
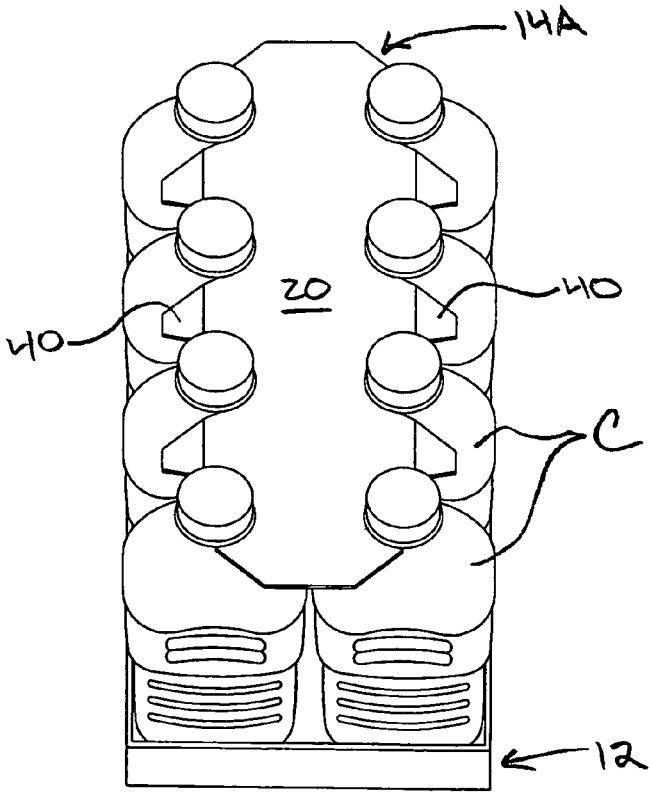
FIG. 8 is another perspective view of the system shown in FIG. 7.

A second embodiment of a bridge 14A is best shown in FIG. 6. Bridge 14A is similar to bridge 14, but includes extended projections 34A extending outwardly from central planar portion 20. Each extended projection 34A is defined by adjacent recesses 30. An outer portion 40 of each extended projection 34A may be folded downwardly relative to central planar portion 20 along fold lines, as shown by dashed lines. As best shown in FIGS. 7 and 8, outer portions 40 may be angled downwardly toward or against containers C, thereby helping to ensure control and alignment of containers C on tray unit 12 during shrink-wrapping, storage and/or transport. Preferably, outer portions 40 may extend at an angle of about 2° to about 10°, more preferably about 4° to about 7°, relative to central planar portion 20.

Preferably, bridge 14A is formed from a single piece of corrugated cardboard. Outer portions 40 of extended projections 34A may be angled downward by folding or bending prior to or after inserting bridge 14A against containers C. Outer portions 40 may extend outwardly from central planar portion 20 beyond the closure caps of containers C, as best shown in FIGS. 7 and 8. However, the longitudinal diameter D2 of each recess 30 is preferably slightly greater than the diameter of the corresponding neck N received therein, as in the first embodiment. As such, bridge 14A may be easily slipped into place on containers C.

Bridge 14A is easily slipped into place on containers C by aligning outer portions 40 on side 26 (or 28) with the interiorly disposed side of a first row of necks N. Each neck N is received within a corresponding recess 30, just beneath each support flanges F. The opposite side 28 (or 26) of bridge 14A is then dropped into place, so that recesses 30 along second side 28 are adjacent the interiorly disposed side of the second row of necks N, just beneath support flanges F. Before dropping second side 28 in place, the first row of containers C may be pushed and tilted outwardly relative to base 16 so that second side 28 of bridge 14A may be fitted beneath corresponding flanges F on the other row of containers. Once bridge 14A is in place, containers C tip back into place due to gravitational forces.

Figure 9:
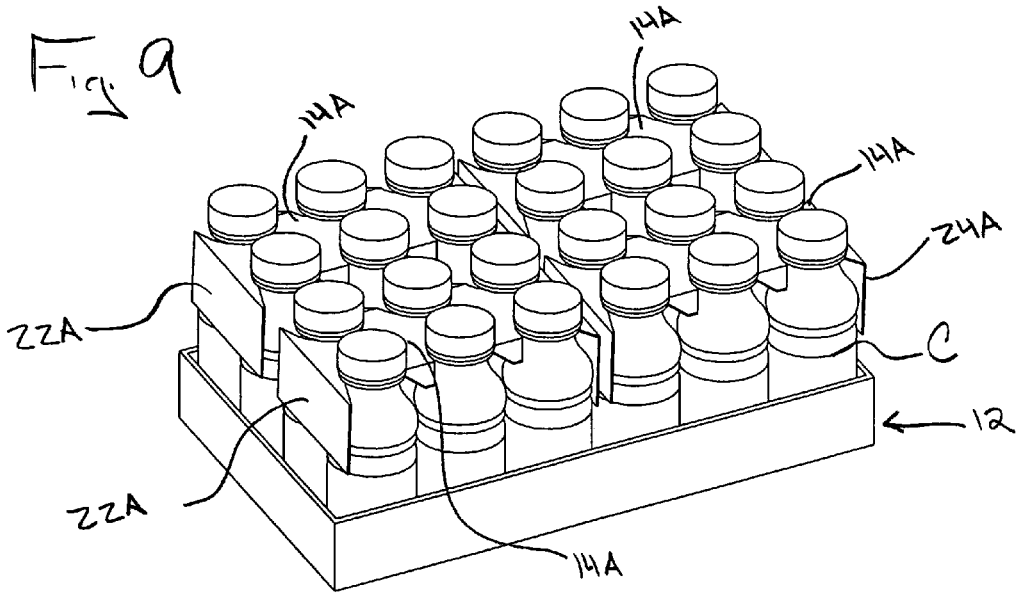
FIG. 9 is a perspective view of a tray unit used with several bridges according to another embodiment holding a plurality of containers.

As described above, bridge 14A may include angled corners 36, 38 connecting and intermediate ends 22, 24 and sides 26, 28. Alternatively, bridge 14A may include one or two extended end tabs 22A, 24A, as bests shown in FIG. 9. End tabs 22A, 24A may be folded downwardly against the central portion of containers C after bridge 14A is inserted onto containers C. Tabs 22A, 24A may include graphics or advertising information corresponding to the product being packaged. Note that each bridge 14A shown in FIG. 9 is configured to receive six containers C, and with four such bridges 14A used with one tray unit 12. Of course, the number of containers C received in each bridge 14A may be increased or decreased as desired by altering the number of recesses 30 disposed thereon.

Figure 10:
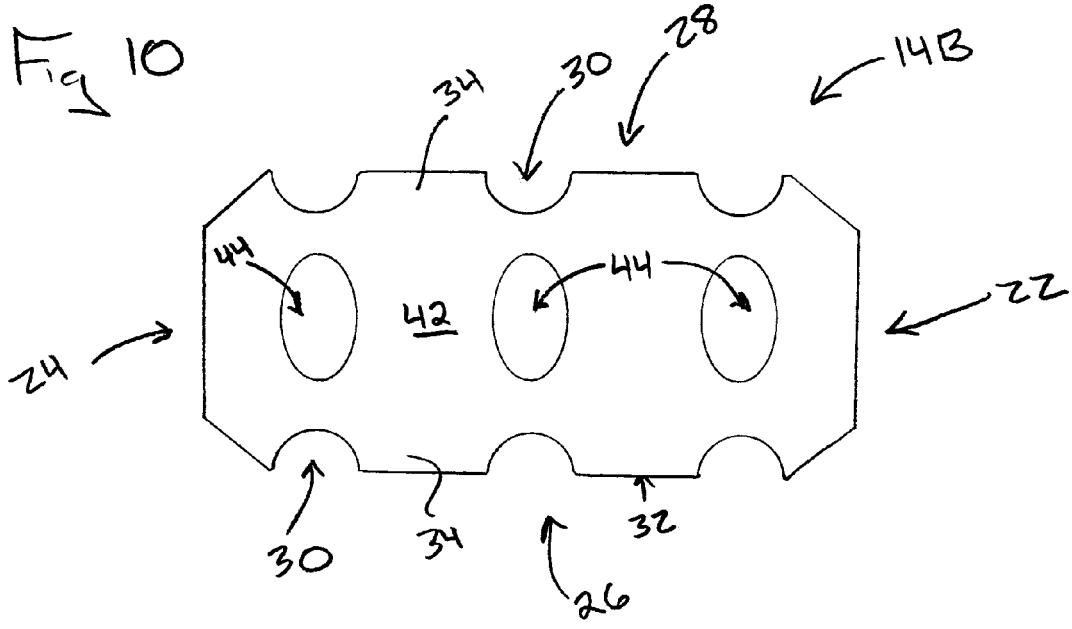
FIG. 10 is a plan view of a bridge according to a third embodiment.

A third embodiment of a bridge 14B is best shown in FIG. 10. Bridge 14B is configured for use with three parallel rows of containers C. Each row may have three or more containers C therein, for a total of nine containers. Bridge 14B may be formed from cardboard or more rigid materials, as described in the other embodiments.

Figure 11:
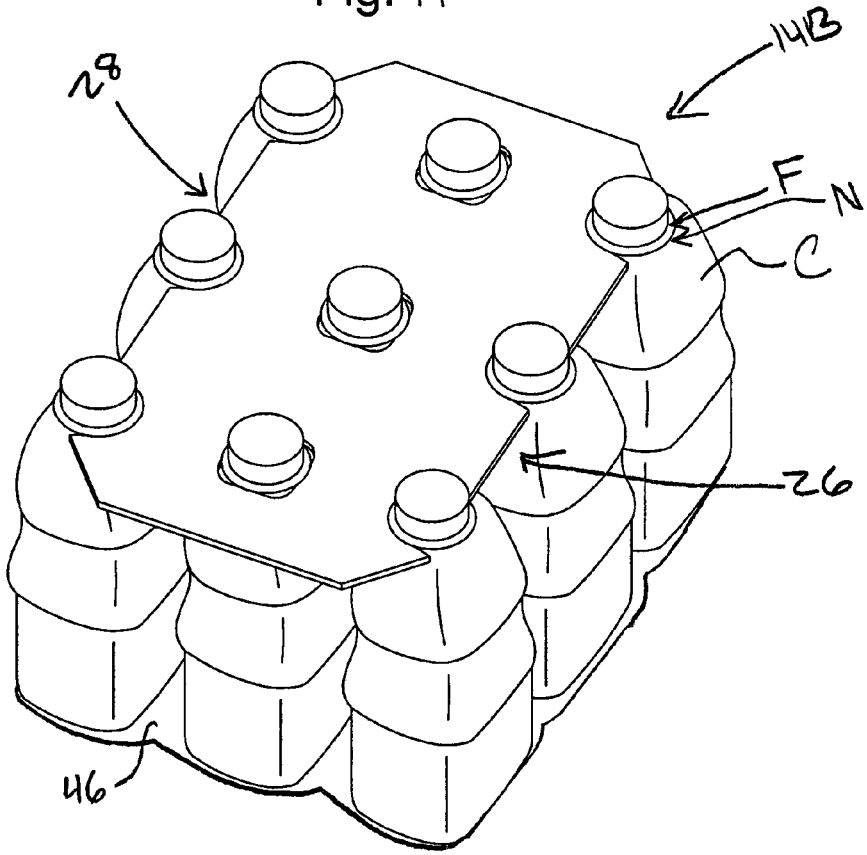
FIG. 11 is a perspective view of the bridge according to the third embodiment and a plate holding three rows of containers.
Figure 12:
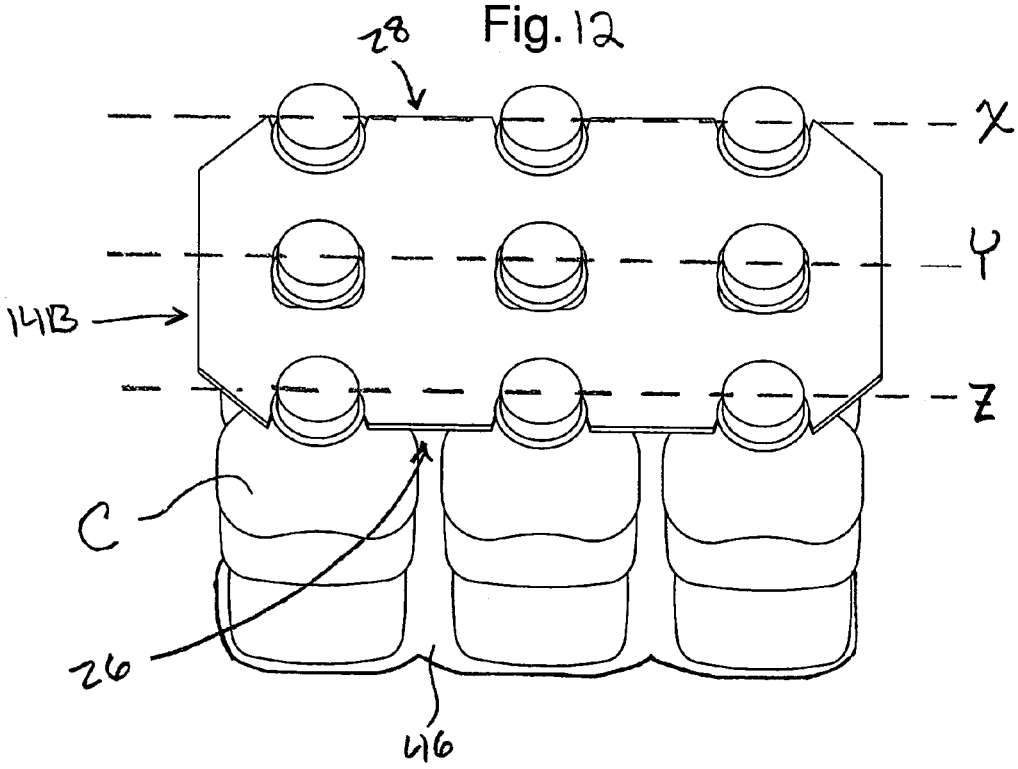
FIG. 12 is another perspective view of the system shown in FIG. 11.

Bridge 14B includes arcuate recesses 30 and projections 34 along its periphery 32, as describe above. Each recess 30 engages an interiorly disposed neck N of one of containers C just below flange F. Recesses 30 engage those containers C provided within the outer rows, as best shown in FIGS. 11 and 12. For example, three rows of containers are shown in FIG. 12 by dashed lines X, Y, and Z. Recesses 30 along side 28 engage interiorly disposed sides of necks N of containers C in row X. Recesses 30 along side 26 engage interiorly disposed sides of necks N of containers in row Z.

Bridge 14B includes a central planar portion 42 having openings 44 for aligning and controlling movement and/or shifting of containers C in intermediate row Y, as best shown in FIGS. 10 and 12. The number of openings 44 corresponds to the number of containers C in row Y. Each opening 44 may be elliptical, as best shown in FIG. 10. The lateral diameter of each opening 44 should be at least slightly greater than the diameter of the support flange F of the corresponding container C being packaged. Preferably, the lateral diameter of each opening is at least 0.125 inch greater than the diameter of the corresponding flange F, so that opening 44 easily fits over flange F. The longitudinal diameter of each opening is preferably 1½ times greater than the diameter of the corresponding flange F, more preferably 2 times greater than the diameter of the corresponding flange F. The elliptical shape of openings 44 allow bridge 14B to be easily slipped into place on containers C.

Alternatively, each opening 44 may have a substantially square configuration, as best shown in FIGS. 11 and 12.

Openings 44 may also have a circular configuration. In any event, each opening 44 should be sized at least slightly larger than the dimensions of flange F (or the closure cap), so that flange F may pass through opening 44 without deforming bridge 14B. However, openings 44 should also be sufficiently small so necks N of containers rest against the edges of planar portion 42 defining openings 44.

As shown in FIGS. 10-12, bridge 14B is configured for use with three rows of containers C, each row including three containers C for a total of nine containers. However, it should be understood that bridge 14B may be easily adapted to hold fewer or more containers C, such as twelve, fifteen, eighteen, twenty-one, twenty-four, etc. containers in three rows by adjusting the number of recesses 30 and openings 44.

Figure 13:
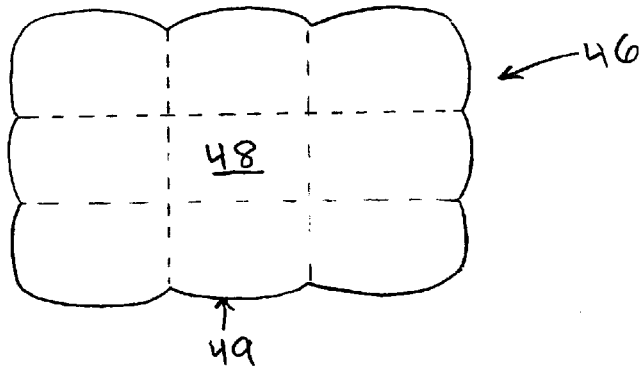
FIG. 13 is a plate according to an embodiment of the present invention.

Bridge 14B may be used with tray unit 12. Accordingly, tray unit 12 is sized to fit three rows of containers. As in the other embodiments, the precise dimensions of tray unit 12 will depend on the dimensions of containers C, as well as the number of containers C, being packaged. Alternatively, bridge 14B may be used with a flat plate 46 of cardboard, plastic, or other material, as best shown in FIGS. 11-12. Plate 46 includes a base 48 on which rows X, Y, Z of containers C are positioned, as best shown in FIG. 13. Plate 46 need not include side or end walls because bridge 14B provides sufficient control and support to containers C. Of course, side and walls may be provided if needed. Plate 46 may include a plurality of depressions, defined by dashed lines, wherein the base of each container is received. Plate 46 may also include a contoured perimeter 49, which conforms to the profile of the bases of the containers C.

Figure 14:
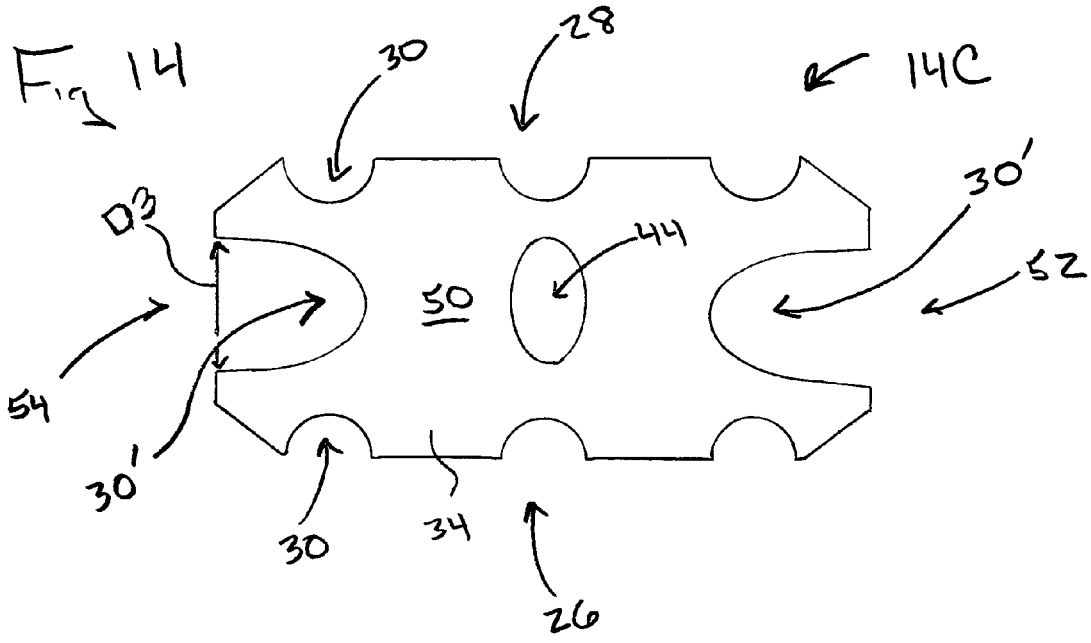
FIG. 14 is a plan view of a bridge according to a fourth embodiment.

A fourth embodiment of a bridge 14C is best shown in FIG. 14. Similar to the third embodiment, bridge 14C is configured to receive three rows of containers C. Bridge 14C includes arcuate recesses 30 and projections 34 along opposite sides 26, 28. Bridge 14C includes a central planar portion 50 having at least one opening 44. In addition, bridge 14C includes an end recess 30' extending into opposite ends 52, 54 of central planar portion 50. Each end recess 30' has a radial diameter D3 approximately equal to the longitudinal diameter of the corresponding opening 44 on bridge 14C. Each recess 30' fans out to the corresponding end 52, 54. Opening 44 and recesses 30' are sized so that flanges F, or closures caps, of containers C may easily pass therethrough, as described above. As with the other embodiments, bridge 14C may be configured to accommodate any number of containers in three rows by adjusting the number of recesses 30 and openings 44.

Figure 17:
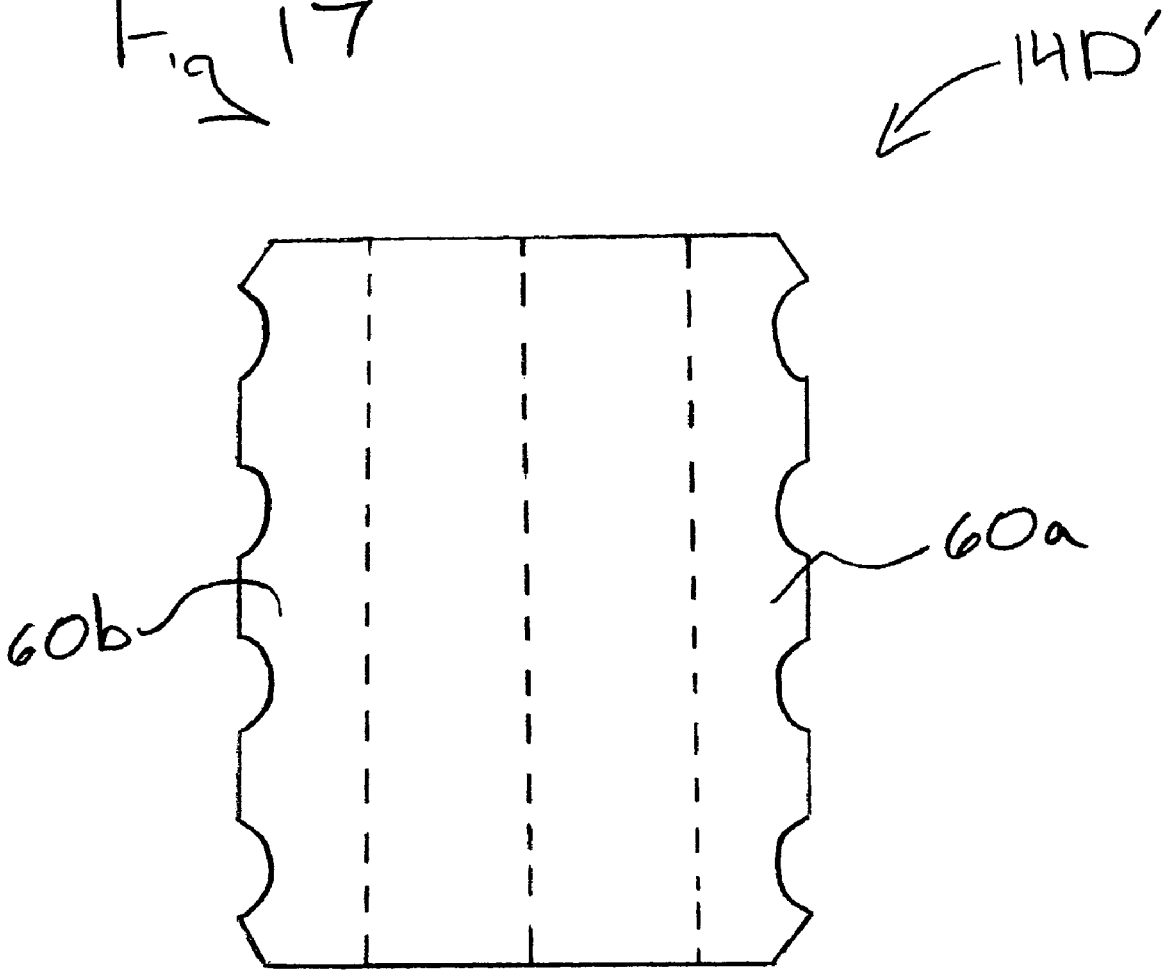
FIG. 17 is a plan view of a cardboard piece which may be folded to form the bridge shown in FIGS. 15 and 16, with fold lines shown as dashed lines.

A fifth embodiment of a bridge 14D is best shown in FIGS. 15 and 16. Bridge 14D is for use with two parallel rows of containers. Bridge 14D may include a central planar portion 20 as described above. Alternatively, a central planar portion having first and second halves 60*a*, 60*b* may be provided. A center beam 62 extends substantially perpendicular to central planar portion halves 60*a*, 60*b*. Preferably, bridge 14D is formed from one piece of corrugated cardboard 14D', which is folded to form center beam 62, as best shown in FIG. 17. Portions 60*a*', 60*b*' are folded along the dashed fold lines to form halves 60*a* and 60*b*. The cardboard piece 14D' is also folded along a center fold line to form center beam 62. As a result, center beam 62 is double the thickness of central planar portion halves 60*a*, 60*b*, as best shown in FIGS. 15 and 16. There may be a slight gap 64 between halves 60*a*, 60*b*. Alternatively, a separate piece of cardboard may be secured to central planar portion 20 by gluing, staples, or the like to form the downwardly protruding center beam 62. If desired, a handle may be secured within gap 64 or onto central planar portion 20. The handle may be formed from cardboard or plastic, and extend upwardly and away from gap 64 or central planar portion 20.

Bridge 14D includes arcuate recesses 30 and projections 34, which engage necks N of containers C as described above. Center beam 62 fits between two rows of containers being packaged, and further supports the containers during shrink-wrapping or banding. As such, center beam 62 further ensures that containers C will maintain their position on tray unit 12 or plate 46 during shrink-wrapping, even if containers C are relatively light weight. In addition, center beam 62 provides support to downwardly directed top forces acting on containers C, such as when another tray unit 12 is stacked on top of containers C. Thus, center beam 62 acts as a top load enhancer.

The present invention also relates to a method of packaging containers C. A tray unit 12 (or plate 46) is provided. A plurality of containers C are positioned on the base 16 of tray unit 12 (or base 48 of plate 46). The number of containers C being packaged will depend on the size of the containers C, as well as the size of tray unit 12. As such, tray unit 12 should be sized to fit a desired number of containers C, so that the containers C do not slide around within tray unit 12 when it is filled with the desired number. After the containers C are positioned on tray unit 12, bridge 14 is slipped into place. Bridge 14 fits against the interiorly disposed sides of necks N of containers C, just below their corresponding support flanges F. Bridge 14 may be manually slipped into place. Alternatively, bridge 14A, 14B, 14C, or 14D may be used, and installed using the same method. Bridge 14 (or 14A, 14B, 14C 14D) may also be positioned against containers C using a mechanized apparatus.

Bridge 14 may be held over containers C so that central planar portion 20 is angled downwardly relative to support flanges F. While maintaining bridge 14 at an angle, bridge 14 is released so that recesses 30 along one side 26 of bridge 14 slide into position just below flange supports F of one row of containers C. Bridge 14 is then pushed into position by tilting containers C received in recesses 30 of side 26 outwardly. Recesses 30 of opposite side 28 then falls into place adjacent the interiorly disposed necks N of the opposite row of containers C. Bridge 14 is released so that central planar portion 20 lies on a plane substantially parallel to the plane of the top or closure caps of the containers C. The first row of containers C tilt back into position due to gravitational forces, forcing recesses 30 of second side 28 against necks N of the corresponding row of containers, just below support flanges F. Thus, containers C are initially pushed laterally outward, but tip back into position once bridge 14 is in place due to the weight of containers C.

After bridge 14 (or 14A, 14B, 14C, or 14D) is in position, containers C may be shrink-wrapped using conventional shrink-wrapping techniques. Standard grade shrink-wrap packaging material is known in the art, and often used when bulk packaging PET bottles, and the like. The packaged, shrink-wrapped containers C may then be passed through a heat tunnel to activate the shrink-wrap. Alternatively, metal, plastic or rubber banding, twine, rope or the like may be applied around containers C.

During the shrink-wrap process, an inwardly directed force is exerted against the containers C, toward the center of tray unit 12. Without bridge 14 (or 14A, 14B, 14C, or 14D), the tension created by the shrink-wrap may force the containers C to tilt inward, with the tops of the containers C drawn inwardly toward each other. The force of the shrink wrapping process would thereby cause the containers C to be tilted inwardly. As noted above, this tilting adversely affects top load capability, and may deform or destroy the packaged containers, particularly when the containers C are stacked during transport or storage. Furthermore, load stress points may be created on the bottoms of the titled containers C. It is difficult to stack packaged containers that are not properly aligned within their packaging. Upon stacking a shrink-wrapped, tray unit of containers on top of another, the random and/or titled alignment of closure caps may create further stacking misalignment situations. Thus, storage and handling are adversely affected by deformation of containers C. Such problems are particularly prevalent with plastic containers.

Bridge 14 (or 14A, 14B, 14C, or 14D) minimizes or eliminates titling and/or shifting of containers C relative to tray unit 12 or plate 46, even during shrink-wrapping and activation thereof. Specifically, bridge 14 counteracts the inwardly directed forces created by the shrink wrapping process, maintaining the containers in their proper position on tray unit 12 (or plate 46). Top load capability is thereby maximized, and the occurrence of load stress points due to tilting or shifting minimized. Bridge 14 (or 14A, 14B, 14C, or 14D), in conjunction with tray unit 12, maintains the containers C in their desired position. Any tension applied to the containers C by the shrink-wrapping process is controlled by bridge 14 (or 14A, 14B, 14C, or 14D). In addition, the shrink wrap forces bridge 14 (or 14A, 14B, 14C, 14D) into position against containers C, thereby securely locking bridge 14 in place. In effect, the shrink wrap acts as a clamp to draw and hold bridge 14 in position against containers C.

Packaging system 10 is cost effective because a relatively minimal amount of material is required. As noted above, the material required to form tray unit 12 is minimized by the relatively low height of sidewalls 18. The height of sidewalls 18 may be reduced in height due to the added control provided by bridge 14. In this way, material savings are achieved without compromising stability of the packaged containers C. For example, a conventional cardboard packaging carton (i.e. such as an RSC) having sidewalls extending upwardly to a height of about 100% or more of the total height of the containers, and having a top and bottom, typically costs about $0.60 to manufacture. By comparison, tray unit 12 and bridge 14 together cost less than $0.20 to manufacture. The addition of bridge 14 reduces and/or eliminates the need for relatively high sidewalls on the corresponding bottom tray, while reducing material costs compared to conventional packaging systems. (Note that other conventional packaging systems, such as crates that completely encase the containers, are even more expensive than conventional cardboard packaging cartons). Cost of materials is further reduced if plate 46 is used, given plate 46 is a flat piece of material such as cardboard lacking side or end walls.

The disclosed invention provides for excellent top load capabilities with a relatively minimal amount of material. For example, a conventional cardboard packaging tray typically provides minimal or no benefit for increasing overall bulk package top load capability, or for increasing the overall stability of the bulk tray unit. Furthermore, top load capability of a conventional packaging tray is often decreased when the packed tray is shrink-wrapped because the bottles tend to shift during the shrink wrapping operation, as noted above. Therefore, bottles are sometimes fully encased in a re-shipping carton ("RSC") to minimize movement of the bottles during shipping, stacking and storage. The material used to form the RSC may increase top load capability, and provide some movement control for the bottles, but the cost is greatly increased compared to the conventional packaging tray.

Recent improvements in bottle design have created bottles that exhibit relatively high top loadable capability. Such bottles need not be packaged in full-wrap RSCs to achieve adequate top load capability for most warehousing and transport requirements. For example, such new containers may exhibit top load a capability of between about 85 pounds per square inch (psi) to about 120 psi. However, such bottles may still require packaging in a carton-type enclosure system to prevent shifting of the bottles. The cost of packaging is again increased for improved bottle control and minimized shifting.

Packaging system 10 minimizes shifting or movement of the containers within the need for any additional carton-style enclosure system, such as an RSC. Thus, the ability to control of the containers is increased, which increases the ability to utilize and maintain the intended and designed maximum top load capabilities of the containers in tray unit 12. Furthermore, this control is provided without the necessity of using an RSC or other expensive packaging material. Packaging system 10 is particularly beneficial for controlling the new, high top load container designs, such as containers exhibiting a top load capability of 85 psi or more. Shifting of the packaged containers during shrink wrap operations, shipping, and other warehouse processes is minimized with packaging system 10, at a relatively low cost.

Packaging system 10 may be used to hold rectangular, square or round bottles. Preferably, all bottles being packaged on a particularly tray unit 12 are of like kind and shape. The bottles should also all have the same total height, so that bridge 14 (or 14A, 14B, 14C, 14D) may engage all of the bottles being bulk packaged.

It should be understood that the disclosed embodiments are for purposes of explanation only, and the present invention is not so limited. Furthermore, while the present invention has been described with reference to maintaining the position of containers during shrink-wrapping, it should be understood that other means of binding the containers may be used. For example, rubber, plastic or metal banding, twine, rope, and the like may be secured around the containers instead of shrink-wrap, which will also exert an inwardly directed force on the containers. The bridges and tray units or plates disclosed herein will counteract the inwardly directed forces of such banding, twine or rope as described above. Further, it would be apparent to one of ordinary skill in the art that various modifications and variations can be made in construction or configuration of the present invention without departing from the scope or spirit of the invention. Therefore, the present invention is intended to include all such modifications and variations, provided they come within the scope of the following claims and their equivalents.

I claim:

1. A system for packaging bottles having a neck portion, said system comprising:

a tray unit having a planar base, first and second opposite sidewalls, and first and second opposite end walls, said sidewalls and end walls extending outwardly from a periphery of said base and connected thereto to define a rectangular structure for holding a plurality of bottles arranged in a series of rows, wherein said sidewalls and said end walls extend upwardly from said base to a height of no more than about 25% of the height of the bottles;

a bridge having a central planar portion and a plurality of arcuate recesses extending into a periphery of said central planar portion, each recess sized to receive a neck portion of one of the bottles.

2. The packaging system of claim 1, wherein said central planar portion includes first and second opposite sides and first and second opposite ends, said plurality of recesses extending into the periphery of said sides.

3. The packaging system of claim 2, wherein each of said sides includes at least two of said recesses.

4. The packaging system of claim 3, wherein at least one of said ends includes a planar tab for folding against the bottles disposed on a corresponding end of said tray so that said planar tab lies on plane substantially perpendicular to the plane of said central planar portion.

5. The packaging system of claim 1, wherein each recess has one of a semi-circular configuration and a semi-elliptical configuration.

6. The packaging system of claim 5, wherein each recess has a lateral radius that is substantially equal to a radius of the neck portion.

7. The packaging system of claim 6, wherein each recess has a longitudinal diameter that is greater than a diameter of the neck portion.

8. The packaging system of claim 5, wherein each recess has a longitudinal diameter that is substantially equal to a diameter of the neck portion.

9. The packaging system of claim 1, wherein said bridge is formed from a material selected from the group consisting of single layer cardboard, corrugated cardboard, plastic sheet material, wood, and wood composite.

10. The packaging system of claim 1, wherein said tray unit is formed from a material selected from the group consisting of single layer cardboard, corrugated cardboard, plastic sheet material, wood, and wood composite.

11. The packaging system of claim 3, wherein said central planar portion includes at least one aperture sized to receive the neck portion of a corresponding bottle.

12. The packaging system of claim 11, wherein said central planar portion includes at least three linearly disposed apertures.

13. The packaging system of claim 12, wherein said aperture has one of a circular configuration, an elliptical configuration, and a square configuration.

14. The packaging system of claim 11, wherein said first and second ends include first and second arcuate recesses, respectively, said aperture and said end recesses are linearly disposed.

15. The packaging system of claim 14, wherein said bridge further comprises angled corners, each of said corners intermediate said end and a corresponding side.

16. The packaging system of claim 15, wherein each angled corner extends at an angle of about 45° relative to the corresponding end.

17. The packaging system of claim 1, wherein said bridge includes graphics printed on an exteriorly disposed surface.

18. The packaging system of claim 1, further comprising a means of binding the bottles together, wherein said means of binding creates an inwardly directed force against the bottles, said bridge counteracting the inwardly directed force and thereby maintaining the bottles in an upright position on said planar base.

19. The packaging system of claim 18, wherein said means of binding the bottles is selected from the group consisting of shrink-wrap, banding, twine and rope.

20. A system for packaging bottles having a neck portion, said system comprising:

a rectangular plate having a base on which a plurality of bottles stand in a present series of rows;

a bridge having a central planar portion with at least one aperture extending through said central planar portion, and a plurality of arcuate recesses extending into a periphery of said central planar portion, each recess and each aperture sized to receive a neck portion of one of the bottles; and a means of binding the bottles together, wherein said means of binding creates an inwardly directed force against the bottles, said bridge counteracting the inwardly directed force and thereby maintaining the bottles in an upright position on said base.

21. The packaging system of claim 20, wherein said base includes a plurality of depressions, each depression sized to receive a corresponding bottom of one of the bottles.

22. The packaging system of claim 20, wherein each recess has an arc of about 180° or less.

23. The packaging system of claim 20, wherein said central planar includes first and second opposite sides and first and second opposite ends, said plurality of recesses extending into the periphery of said sides.

24. The packaging system of claim 23, wherein each of said sides includes at least three of said recesses.

25. The packaging system of claim 24, wherein said central planar portion includes at least three linearly disposed apertures, said linearly disposed apertures parallel to said first and second sides.

26. The packaging system of claim 21, wherein each recess has a lateral radius that is substantially equal to a radius of the neck portion.

27. The packaging system of claim 26, wherein each recess has a longitudinal diameter that is greater than a diameter of the neck portion.

28. The packaging system of claim 26, wherein each recess has a longitudinal diameter that is substantially equal to a diameter of the neck portion.

29. The packaging system of claim 21, wherein said bridge is formed from a material selected from the group consisting of single layer cardboard, corrugated cardboard, plastic sheet material, wood, and wood composite.

30. The packaging system of claim 21, wherein said plate is formed from a material selected from the group consisting of single layer cardboard, corrugated cardboard, plastic sheet material, wood, and wood composite.

31. The packaging system of claim 23, wherein said first and second ends include first and second arcuate recesses, respectively, said aperture and said end recesses are linearly disposed.

32. The packaging system of claim 20, wherein said means of binding the bottles is selected from the group consisting of shrink-wrap, banding, twine and rope.

33. A method of packaging a plurality of bottles, including the steps of:

providing a rectangular plate having a substantially planar base;

arranging a plurality of bottles on the plate in a series of rows, each of the bottles having a neck portion and a top, the tops of the bottles lying on a first plane;

providing a bridge having a central planar portion with first and second opposite sides and first and second opposite ends, the central planar portion including a plurality of arcuate recesses extending into a periphery of the first and second sides, each recess sized to receive a neck portion of one of the bottles;

aligning the bridge with the bottles so that the central planar portion is above the tops and angled relative to the first plane;

positioning the first side against a first outer row of the bottles so that the recesses along the first side engage the necks of the bottles of the first outer row; and positioning the second side against a second outer row opposite the first outer row so that the recesses along the second side engage the necks of the bottles of the second outer row.

34. The method of claim 33, including the further step of shrink wrapping the packaged bottles after said positioning steps.

* * * * *